OR 4,053,877

552

United States

Torlesse et al.

4,053,877

Oct. 11, 1977

[54] METHOD OF AND APPARATUS FOR SURVEYING AN AREA

[75] Inventors: Arthur Timothy Torlesse, Chichester; Anthony Wulston Bovill; Robert Charles West, both of Fareham, all of England

[73] Assignee: Plessey Handel und Investments AG, Zug, Switzerland

[21] Appl. No.: 641,358

[22] Filed: Dec. 16, 1975

[30] Foreign Application Priority Data

Dec. 31, 1974 United Kingdom ..... 56093/74

[51] Int. Cl.[2] ..... G08B 13/24

[52] U.S. Cl. ..... 340/258 R; 325/52; 340/38 L; 325/29

[58] Field of Search ..... 340/38 R, 38 L, 258 R, 340/258 A, 258 B, 258 C; 325/29, 52; 343/894

[56] References Cited

U.S. PATENT DOCUMENTS

| | | | |
|---|---|---|---|
| 2,971,184 | 2/1961 | Pearson et al. | 340/258 C |
| 3,031,643 | 4/1962 | Sheftelman | 340/258 R |
| 3,043,952 | 7/1962 | Reid | 340/38 L |
| 3,230,518 | 1/1966 | Vassil et al. | 340/258 C |
| 3,237,105 | 2/1966 | Kalmus | 325/29 |
| 3,641,569 | 2/1972 | Bushnell et al. | 340/38 L |
| 3,668,625 | 6/1972 | Wolf et al. | 340/38 R |
| 3,750,125 | 7/1973 | Ross et al. | 340/258 C |
| 3,801,976 | 4/1974 | Ross et al. | 340/258 R |

*Primary Examiner*—John W. Caldwell
*Assistant Examiner*—Joseph E. Nowicki
*Attorney, Agent, or Firm*—Fleit & Jacobson

[57] ABSTRACT

A security system for surveying an area such as a prison or airport, the security system comprising three coaxial cables which are placed in the ground parallel to and spaced apart from each other, the center cable being provided with a modulated signal which is received by the outer two cables, and the received signal being caused to vary and trigger an alarm if there is an unauthorized movement in the surveyed area.

1 Claim, 4 Drawing Figures

METHOD OF AND APPARATUS FOR SURVEYING AN AREA

This invention relates to a method of and apparatus for surveying an area. The area to be surveyed may be, for example, a prison, an airport, or more generally any area where it is desirable to prevent persons from either escaping or intruding.

Accordingly, this invention provides a security system for surveying an area for the movement of unauthorised personnel in the area, which security system comprises, in combination, alarm means, and an extended length of a coaxial transmitter cable positioned beneath the surface of the area, the transmitter cable being such that it is adapted to emit radio frequency signals with a low transmission loss, or attenuation, along its length. Thus, the transmitted radio frequency signals are substantially constant along the length of the cable.

An extended length of a coaxial receiver cable is positioned beneath the surface of the area and spaced apart from the transmitter cable. The receiver cable is such that it is adapted to receive the radio frequency signals from the transmitter cable by the radio frequency signals leaking into the receiver cable with substantially uniform strength. Receiver means are provided for receiving signals received by the receiver cable. The security system is such that if unauthorised personnel move in the area then the radio frequency signals received by the receiver means vary and actuate the alarm means.

This invention also provides a security system for surveying an area for the movement of unauthorised personnel in the area, wherein a pair of coaxial receiver cables, each of extended length, is positioned beneath the surface of the area and spaced apart one on either side of the transmitter cable, each receiver cable being such that it is adapted to receive the radio frequency signals from the transmitter cable by the radio frequency signals leaking into the receiver cables with substantially uniform strength.

Preferably, the radiating cables (i.e., leaky cables) are radiating coaxial cables having a low attenuation. However, if desired, ordinary wires may be employed, but in this case, there may be a fairly fast signal drop off from the first cable.

Preferably, the modulated signals are amplitude modulated but the signals could equally well be frequency, phase or pulse modulated depending upon the type of signal desired. The signals may be a continuous one or a pulse signal and usually the signals applied to the first cable will be received unaltered by the second and third cables. Preferably, the signals are low band width, low frequency continuous wave signals. Thus, for example, the signals may be 30–150 MHz with a low frequency modulation of, for example, not more than 10 kHz.

The receiving means preferably includes a differential transformer. The differential transformer gives inherent noise cancellation which reduces the effects of any extraneous radio frequency radiations.

Embodiments of the invention will now be described by way of example and with reference to the accompanying drawings in which:

FIG. 1*a* is a plan view of apparatus in accordance with the invention;

FIG 1*b* is a cross section on the line A—A shown in FIG. 1*a;*

Figure 1A:
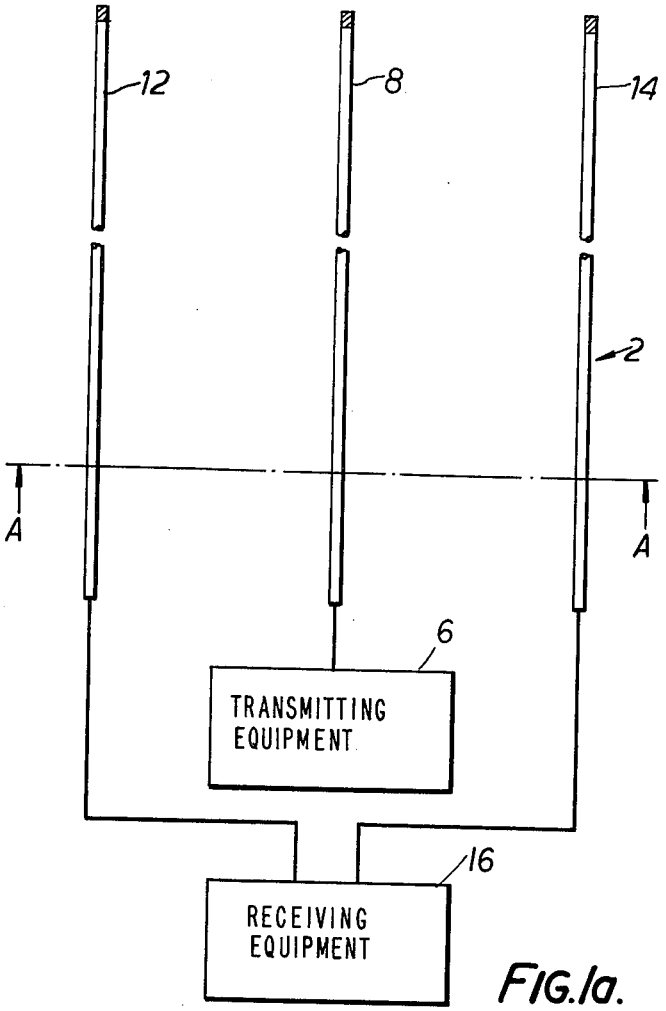
Figure 1B:
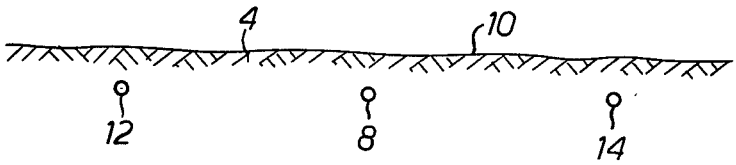

Referring to FIGS. 1*a* and 1*b*, there is shown apparatus 2 for surveying an area in the form of a piece of ground 4. The apparatus 2 comprises transmitting equipment 6 for transmitting a modulated signal to a first radiating coaxial cable 8 which is buried below the surface 10 of the ground 4. The modulated signal may be a 150 MHz radio frequency carrier signal modulated with a 30 kHz signal.

The apparatus 2 also comprises second and third receiving coaxial cables 12, 14 also buried beneath the surface 10 of the ground 4. The two cables 12, 14 are equally spaced from the first cable 8 and they receive the modulated signals from the cable 8. The received signals are compared in receiving equipment 16 which substracts the two signals received.

The advantage of having two cables 12, 14 equally spaced from the cable 8 is that if the cables 12, 14 pick up extraneous signals in addition to the modulated signal from the cable 8, then both cables 12, 14 will pick up the same extraneous signals and these will be cancelled out automatically in the receiving equipment 16.

Figure 2:
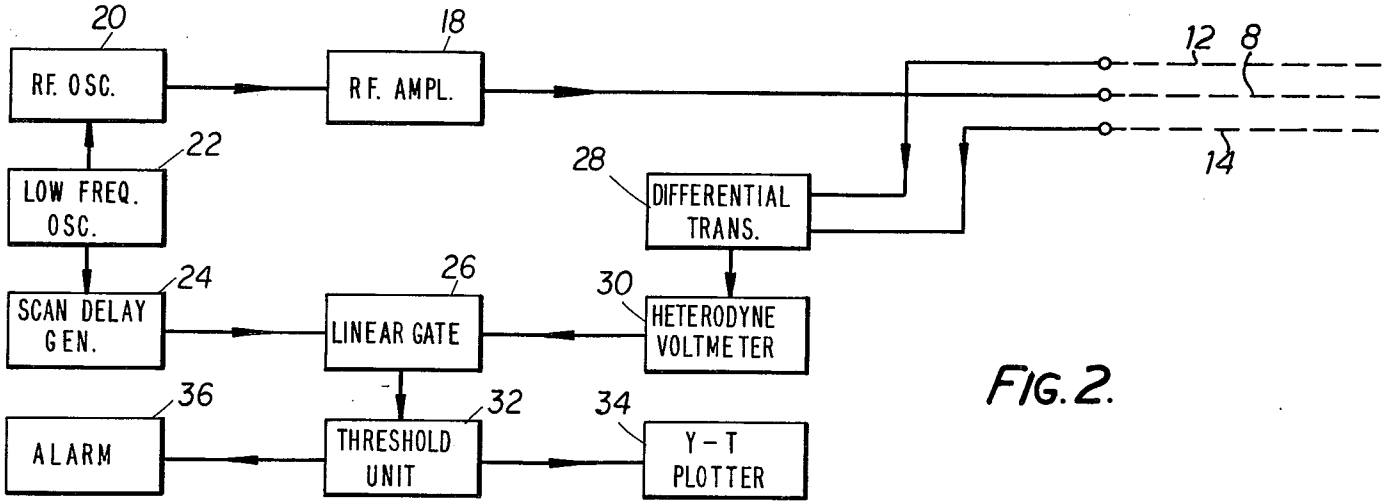
FIG. 2 is a detailed diagram of apparatus in accordance with the invention.

Referring now to FIG. 2 there is shown detailed apparatus in accordance with the present invention. The apparatus includes a coaxial radiating transmitter cable 8 and two coaxial receiving cables 12, 14 equally spaced from each other, e.g. 8 feet apart for the reasons mentioned above in connection with FIGS. 1*a* and 1*b*. The ends of the cables 8, 12, 14 are terminated with 50 ohm loads.

A radio frequency signal is applied to the cable 8 from a radio frequency amplifier 18. The input signal to the radio frequency amplifier 18 is obtained from a radio frequency oscillator 20, the carrier of which is amplitude modulated by the output from a low frequency oscillator 22. The output from the low frequency oscillator 22 is also used to operate a scan delay generator 24 which together with a linear gate 26 form a synchronous detection system.

The two receiving cables 12, 14 are connected to a differential transformer 28 which subtracts the two received signals. The differential transformer 28 not only increases the sensitivity of the system by reducing the standing signal levels to be handled, but also inherently provides a measure of noise cancellation due to any other radio transmissions on the same frequency.

The output from the differential transformer 28 is received by a radio frequency receiver in the form of a heterodyne voltmeter 30 which is tuned to the transmission frequency. The detected low frequency modulation signal from the hetrodyne voltmeter 30 is applied to the linear gate 26. The output from the linear gate 26 is applied to a filter and threshold unit 32. The bandwidth of the filter is designed to enhance the performance at the rates of change in signal caused by an intruder or other moving body. The output from the filter can be displayed on a Y-T (amplitude-time) plotter 34 for constant monitoring purposes and/or can be applied to the threshold unit. The amplitude of the threshold unit can be preset to give an alarm output when exceeded, said alarm output triggering an alarm 36. The alarm 36 can be audible and/or visual.

The system as described above can be used in prisons or on airfields. It can be used to detect movement above, on or underneath the ground as there will be a three dimensional area of signal radiation around the cable 8.

Figure 3:
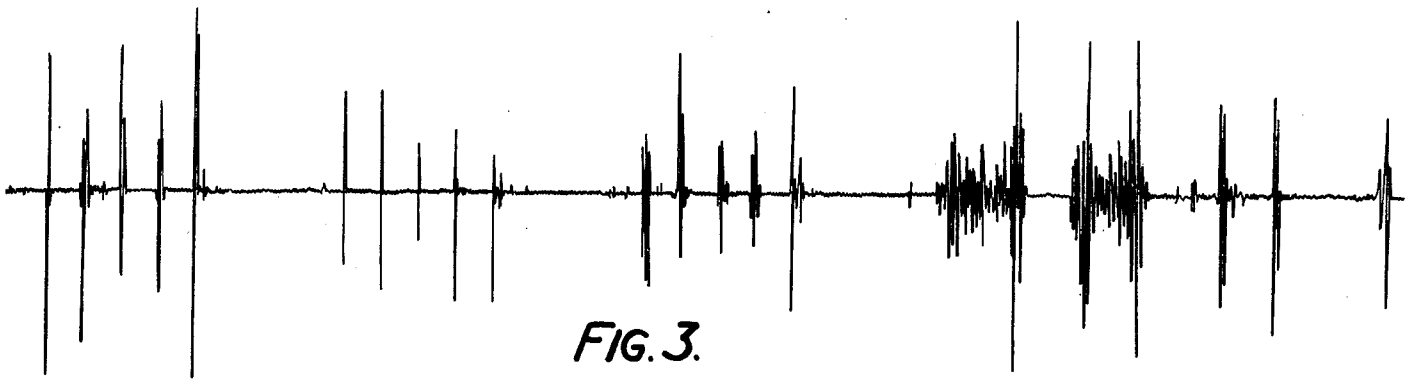
FIG. 3 shows various parts of monitored signals that may be obtained from a moving body in an area under surveillance.

Referring now to FIG. 3, there is shown from left to right a signal obtained by a person walking across the cables, a signal obtained by a person running across the cables, a signal obtained by a person jumping across the cables, a signal obtained by a person walking slowly between the cables, a signal obtained by a person running between the cables, and a signal obtained by a person walking slowly over the cables.

It is to be appreciated that the embodiments of the invention described above have been given by way of example only and that modifications may be effected. Thus, for example, as an alternative to burying the cables in ground 4, they could be laid upon the surface of the ground or run along a wall or fence. If desired, some cables could be provided in the ground and some cables could be provided along a wall or fence so that the apparatus of the invention would in fact extend in two planes. There should of course be an appropriate number of coaxial receiving cables chosen so that any extraneous signals picked up can be cancelled out in the receiving equipment. In this connection it will be appreciated that if only one receiving cable is employed, then the extraneous noises picked up cannot easily be cancelled out. If desired, a non-modulated signal can also be used.

What we claim is:

1. A security system for surveying an area for the movement of unauthorized personnel in the area, which security system comprises in combination:

A. alarm means;

B. an extended length of a coaxial transmitter cable positioned beneath the surface of the area, the transmitter cable comprising means for emitting radio frequency signals with a low transmission loss along its length so that the transmitted radio frequency signals are substantially constant along the length of the cable, said means for emitting comprising means for emitting an amplitude modulated continuous signal;

C. a pair of coaxial receiver cables, each of extended length, positioned beneath the surface of the area and spaced apart equally on either side of the transmitter cable, each receiver cable comprising means for receiving the radio frequency signals from the transmitter cable by the radio frequency signals leaking into the receiver cables with substantially uniform strength along the length of the cable; and D. receiver means for receiving signals received by the receiver cable when the radio frequency signals vary due to unauthorized personnel movement in the area, said receiver means including a differential transformer and means for connecting said receiver means to said alarm means.

* * * * *